US006315651B1

(12) United States Patent
Kuo

(10) Patent No.: US 6,315,651 B1
(45) Date of Patent: Nov. 13, 2001

(54) EASY ON/OFF COVER FOR A PAD CONDITIONING ASSEMBLY

(75) Inventor: Ching-Hui Kuo, Shindian (TW)

(73) Assignee: Taiwan Semiconductor Manufacturing Company Ltd, Hsin Chu (TW)

( * ) Notice: Subject to any disclaimer, the term of this patent is extended or adjusted under 35 U.S.C. 154(b) by 0 days.

(21) Appl. No.: 09/815,359

(22) Filed: Mar. 22, 2001

(51) Int. Cl.[7] ..... B24B 55/04
(52) U.S. Cl. ..... 451/451; 451/443
(58) Field of Search ..... 451/41, 56, 60, 451/66, 287, 288, 289, 443, 444, 340, 451, 455

(56) References Cited

U.S. PATENT DOCUMENTS 5,785,585 * 7/1998 Manfredi et al. ..... 451/288
6,022,807 * 2/2000 Lindsey, Jr. et al. ..... 438/693
6,135,855 * 10/2000 Vanell ..... 451/14

* cited by examiner

*Primary Examiner*—Derris H. Banks
(74) *Attorney, Agent, or Firm*—Tung & Associates

(57) ABSTRACT

A cover for a pad conditioning assembly for use in a chemical mechanical polishing apparatus and a pad conditioning assembly incorporating such cover are disclosed. The cover may be formed of a body portion with at least two boss sections and at least two locking tabs mounted in the boss sections. The cover provides a quick mount/dismount to a support plate of a pad conditioning assembly by engaging and disengaging the blocking tabs. The cover further provides the advantage that when a substantially transparent material is used in fabricating the cover, any malfunction or breakage of the components under the cover can be readily observed. The cover is further provided with an extended skirt section such that all the major components of the pad conditioning assembly can be shielded a slurry solution and cleaning fluids.

20 Claims, 4 Drawing Sheets

EASY ON/OFF COVER FOR A PAD CONDITIONING ASSEMBLY

FIELD OF THE INVENTION

The present invention generally relates to a polishing pad assembly for a chemical mechanical polishing apparatus and more particularly, relates to a cover for a polishing pad condition arm in a chemical mechanical polishing apparatus that can be mounted and dismounted expeditiously without screw attachments.

BACKGROUND OF THE INVENTION

Apparatus for polishing thin, flat semi-conductor wafers is well not in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus is shown in FIG. 1A. The CMP apparatus 10 consists of a controlled mini-environment 12 and a control panel section 14. In the controlled mini-environment 12, typically four spindles 16, 18, 20, and 22 are provided (the fourth spindle 22 is not shown in FIG. 1*a*) which are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disc 30 rotated by a motor (not shown) in a direction opposite to the rotational direction of the polishing head 26.

Also shown in FIG. 1*a* is a conditioner arm 32 which is equipped with a rotating conditioner disc 34. The conditioner arm 332 pivots on its base 36 for conditioning the polishing pad 38 for the in-situ conditioning of the pad during polishing. While three stations each equipped with a polishing pad 28, 38 and 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e., over the polishing pad 28. Simultaneously, a polished wafer mounted on spindle 20 is moved into the head clean load/unload station for unloading.

A cross-sectional view of a polishing station 42 is shown in FIGS. 1B and 1C. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

An enlarged cross-sectional representation of the polishing action which results form a combination of chemical and mechanical effects is shown in FIG. 1C. The CMP method can be used to provide a planner surface on dielectric layers, on deep and shallow trenches that are filled with polysilicon or oxide, and on various metal films. A possible mechanism for the CMP process involves the formation of a chemically altered layer at the surface of the material being polished. The layer is mechanically removed from the underlying bulk material. An outer layer is then regrown on the surface while the process is repeated again. For instance, in metal polishing, a metal oxide layer can be formed and removed repeatedly.

During a CMP process, a large volume of a slurry composition is dispensed. The slurry composition and the pressure applied between the wafer surface and the polishing pad determine the rate of polishing or material removal from the wafer surface. The chemistry of the slurry composition plays an important role in the polishing rate of the CMP process. For instance, when polishing oxide films, the rate of removal is twice as fast in a slurry that hag a pH of 11 than with a slurry that has a pH of 7. The hardness of the polishing particles contained in the slurry composition should be about the same as the hardness of the film to be removed to avoid damaging the film. A slurry composition typically consists of an abrasive component, i.e, hard particles and components that chemically react with the surface of the substrate. For instance, a typical oxide polishing slurry composition consists of a colloidal suspension of oxide particles with an average size of 30 nm suspended in an alkali solution at a pH larger than 10. A polishing rate of about 120 nm/min can he achieved by using this slurry composition. Other abrasive components such as ceria suspensions may also be used for glass polishing where large amounts of silicon oxide must be removed. Ceria suspensions act as both the mechanical and the chemical agent in the slurry for achieving high polishing rates, i.e, larger than 500 nm/min. While ceria particles in the slurry composition remove silicon oxide at a higher rate than do silica, silica is still preferred because smoother surfaces can be produced. Other abrasive components, such as alumina ($Al_3O_2$)may also be used in the slurry composition.

The polishing pad 28 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing" wherein the surface of a polishing pad becomes smooth such that the pad no longer holds slurry in-between the fibers. This is a physical phenomenon on the pad surface not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, re-open the pores, and thus forms micro-scratches in the surface of the pad for improved life time. The pad conditioning process can be carried out either during a polishing process, i.e. known as concurrent conditioning, or after a polishing process.

While the pad conditioning process improves the consistency and lifetime of a polishing pad, a conventional conditioning disk is frequently not effective in conditioning a pad surface after repeated usage. A conventional conditioning disk for use in pad conditioning is shown in FIGS. 2A and 2B.

Referring now to FIG. 2A, wherein a perspective view of a CMP publishing station 42 is shown. The polishing station 42 consists of a conditioning head 52, a polishing pad 28, and a slurry delivery arm 54 positioned over the polishing pad. The conditioning head 52 is mounted on a conditioning arm 58 which is extended over the top of the polishing pad 28 for making sweeping motion across the entire surface of the pad. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process. The surface grooves 64 while serving an important function of distributing the slurry also presents a processing problem when the pad surface 60 gradually worn out after successive use.

The conditioning disk 68, shown in FIG. 25 is formed by embedding or encapsulating diamond particles 50 in nickel 56 coated on the surface 70 of a rigid substrate 22. FIG. 2B is a cross-sectional view of a new conditioning disk with all the diamond particles 32 embedded in nickel 34. In the fabrication of the diamond particle conditioning disk 68, a nickel encapsulant 56 is first mixed with a diamond grit which includes diamond particles 50 and then applied to the rigid substrate 22.

The conventional pad conditioning arm 58 (shown in FIG. 2A) is provided with a cover member 72 for enclosing the pad conditioner components such as pulleys 74, 78 drive belt 80 and a support plate 82 (shown in FIGS. 5 and 6) and shielding these components from being contaminated by the polishing slurry and the cleaning liquids. The conventional cover 72 for the pad conditioning arm 58 is fabricated of a non-transparent plastic material and must be fastened to the arm 58 by a plurality of screws 84, as shown in FIG. 2A. The polishing arm cover 72 has a number of drawbacks. First, the mounting or dismounting of the cover 72 from the arm 58 requires the tightening or loosening of the plurality of screws, i.e., a total number of 9 screws, which is a very time consuming process. Secondly, due to the nature of the plastic material used to fabricate the cover, i.e., a non-transparent plastic, any malfunction or breakage of components under the cover, i.e., any breakage of the drive belt 80 or the pulleys 74, 78 cannot be easily detected. Thirdly, the conventional cover 72 supplied by the machine manufacturer does not have a sufficient depth to shield the support plate 82 (shown in FIG. 5) and thus the internal components under the cover member 72 can be contaminated by a slurry solution or by cleaning fluids.

It is therefore an object of the present invention to provide a conditioning assembly for use in the chemical mechanical polishing apparatus that does not have the drawbacks or shortcomings of the conventional head conditioning assembly.

It is another object of the present invention to provide an easy on/off cover for a pad conditioning assembly that can be easily mounted or dismounted from a pad conditioning arm.

It is a further of jet of the present invention to provide a cover member for a pad conditioning arm that is not mounted to the arm by screw means.

It is another further object of the present invention to provide a cover for a pad conditioning arm used in a chemical mechanical polishing apparatus that is fabricated of a substantially transparent material to allow visual observation of the pad conditioning assembly components under the cover.

It is still another object of the present invention to provide an easy on/off cover for a pad conditioning assembly used in a chemical mechanical polishing apparatus which can be mounted to a pad conditioning arm by at least two locking tabs.

It is yet another object of the present invention to provide an easy on/off cover for a pad conditioning assembly used in a chemical mechanical polishing apparatus that utilizes four locking tabs for fastening the cover to the support plate of the pad conditioning.

It is still another further object of the present invention to provide an easy on/off cover for a pad conditioning assembly that is equipped with an extended skirt portion for yielding the components of the pad conditioning assembly from contamination by a slurry solution or by cleaning fluids.

It is yet another further object of the present invention to provide an easy on/off cover for a pad conditioning assembly used in a chemical mechanical polishing apparatus that is fabricated of two substantially transparent acrylic plastic.

SUMMARY OF THE INVENTION

In accordance with the present invention, a cover for a pad conditioning assembly used in a chemical mechanical polishing apparatus and a pad conditioning assembly are provided.

In a preferred embodiment, a cover for a pad conditioning assembly used in a CMP apparatus is provided which includes a body that is formed of two substantially circular sections adapted for accommodating two pulleys connected by an elongated, substantially linear section therein between, the body has a substantially flat top surface, a curvilinear sidewall and an open bottom; two boss sections situated opposite each other which are integrally formed in the curvilinear sidewall each has a mounting hole that opens to a bottom surface of the curvilinear sidewall; and two locking tabs each mounted in a mounting hole in one of the at least two boss sections by a mounting pin, each of the at least two locking tabs is rotatable about the mounting pin so as to rotate from a release position to a lock position upon engaging an edge portion of a support plate of the pad condition assembly.

In the cover for a pad conditioning assembly used in a CMP apparatus, the body may be formed of a polymeric material that is substantially, optically transparent. The curvilinear sidewall of the body may have a depth that is sufficiently large to shield substantially all components in the pad conditioning assembly from polishing slurry and cleaning liquids. Each of the at least two locking tabs my further include a frictional surface on a tip portion opposite to the mounting pin for frictionally engaging the edge portion of the support plate. The mounting pin may be provided with screw threads. The at least two locking tabs may be fabricated of a metallic material. The body may be formed of an acrylic plastic.

The present invention is further directed to a pad conditioning assembly that is used in a CMP apparatus which includes a support plate of elongated shape formed of a rigid material; a first and a second pulley each rotatably mounted at an opposite end of the support plate; a drive belt mounted over the first and second pulley for transmitting a rotational motion from the first pulley to the second pulley; and a cover for mounting over the support plate, the first and second pulley and the drive belt which includes a body formed of two substantially circular sections adapted to accommodate two pulleys connected by an elongated, substantially linear section therein between, the body has a substantially flat top surface, a curvilinear sidewall, and an open bottom, at least two boss sections situated opposite to each other integrally formed in the curvilinear sidewall each has a mounting hole that opens to a bottom surface of the curvilinear sidewall, and at least two locking tabs each mounted in a mounting hole through one of the at least two boss sections through the mounting pin, each of the at least two locking tabs is rotatable about the mounting pin so as to rotate from a release position to a lock position upon engaging an edge portion of a support plate of the pad conditioning assembly.

In the pad conditioning assembly used in a CMP apparatus, the body of the cover may be fabricated on a substantially transparent plastic, or fabricated of an acrylic plastic. The assembly may further include a conditioning disk mounted to one of the first and second pulleys for conditioning a polishing pad. The assembly may further include a motor operatively connected to one of the first and second pulley for rotating the pulley. Each of the at least two locking tabs may further include a frictional surface on a tip portion opposite to the mounting pin for frictionally engaging the edge portion of the support plate. The mounting pin may be provided with screw threads. The frictional surface may be formed of an elastomeric material.

In the polishing head conditioning assembly used in a CMP apparatus, the at least two locking tabs may be fabricated of a metallic material, such as aluminum. The support plate may be fabricated of a rigid metal, such as aluminum. The first and the second pulley may be mounted on ball bearings. The curvilinear sidewall of the body may have a depth that is sufficiently large to shield substantially all components in the pad conditioning assembly from a polishing slurry and cleaning fluids. The at least two locking tabs may be four locking tabs with two mounted on each side of the curvilinear sidewall.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a cover for a pad conditioning assembly used in a CMP apparatus and a pad conditioning assembly that incorporates the present invention transparent cover.

The cover for a pad conditioning assembly can be constructed by a body portion, at least two boss sections in a curvilinear sidewall of the body portion, and at least two locking tabs mounted on the body portion for locking the cover to the support plate of a pad conditioning assembly.

The body portion of the present invention novel cover may be formed of two substantially circular sections that are adapted to accommodate two pulleys connected by an elongated, substantially straight section in between the two substantially circular sections. The body has a substantially flat top surface, a curvilinear sidewall and an open bottom. On the open bottom, at least two boss sections situated opposite to each other are integrally formed in the curvilinear sidewall. Each has a mounting hole that opens to a bottom surface of the curvilinear sidewall. The present invention novel cover further includes at least two locking tabs, or four tabs as shown in the preferred embodiment, each mounted to a mounting hole in one of the at least two boss sections by a mounting pin. Each of the locking tabs may be rotatable about the mounting pin such that the tab may be rotated from a release position to a lock position engaging an edge portion of a support plate of the pad conditioning assembly.

The present invention further discloses a pad conditioning assembly that is used in a CMP apparatus. The assembly can be constructed of a support plate, a first and a second pulley, a drive belt and a cover that is substantially transparent and lockable onto the support plate by locking tabs. The support plate may be formed of elongated shape from a rigid material, such as aluminum. The first and the second pulley are rotatably mounted at an opposite end of the support plate. The drive belt is mounted over the first and the second pulley for transmitting the rotational motion from the first pulley to the second pulley, or vice versa. The cover is designed for quick mounting/dismounting onto the support plate by engaging a plurality of locking tabs provided on the bottom open end of the cover. The cover is further fabricated of a substantially transparent material such that all components under the cover can be visually examined to detect any component malfunction. The cover is further fabricated with an extended skirt portion such that all components under the cover, including the support plate, are shielded from polishing slurry and any other cleaning fluids.

Figure 3:
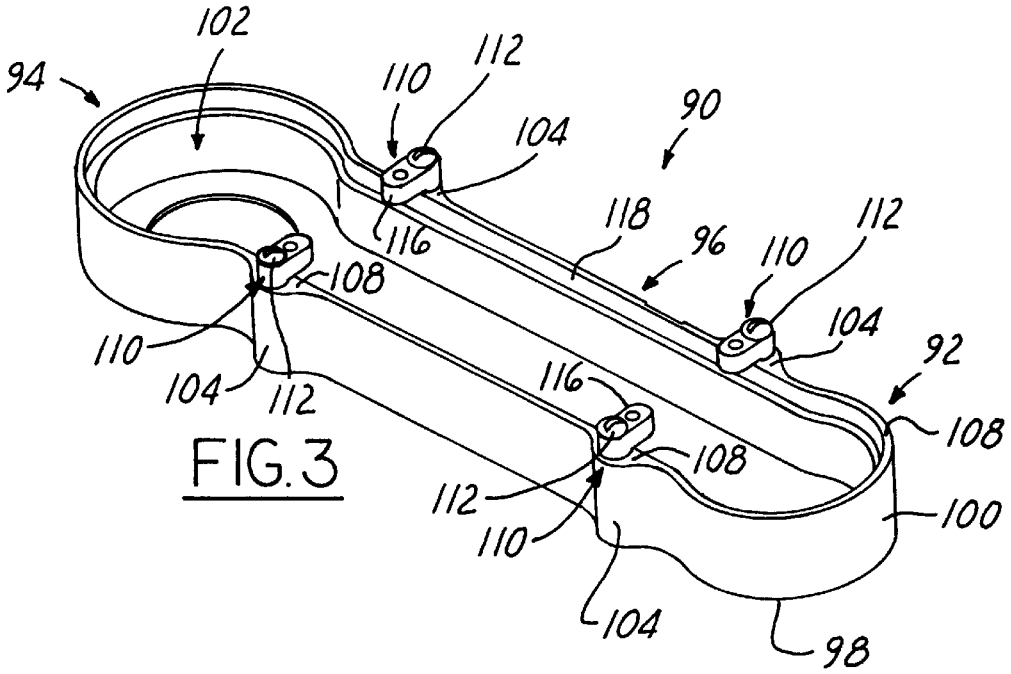
FIG. 3 is a perspective view of the present invention substantially transparent pad conditioning arm cover equipped with four locking tabs.
Figure 4A:
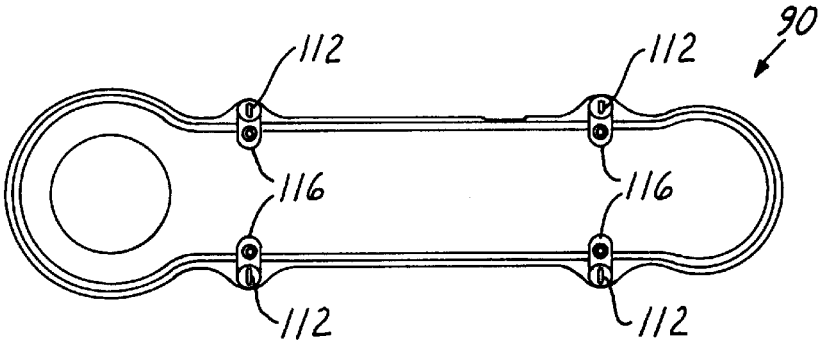
FIG. 4A is a plane view of the present invention cover for a pad conditioning arm of FIG. 3.
Figure 4C:
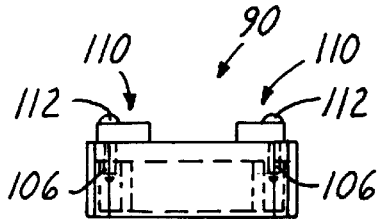
FIG. 4C is an end view of the cover for the pad conditioning arm of FIG. 3.
Figure 4B:
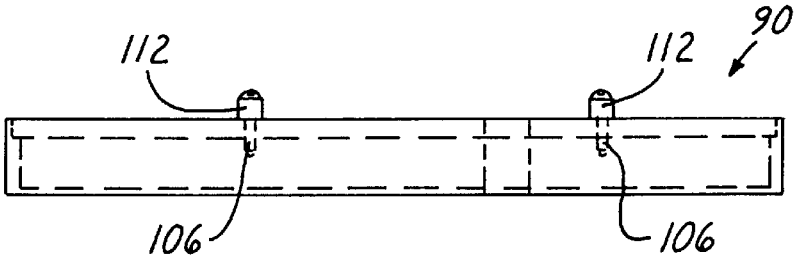
FIG. 4B is a side view of the cover for the pad conditioning arm of FIG. 3.
Figure 6:
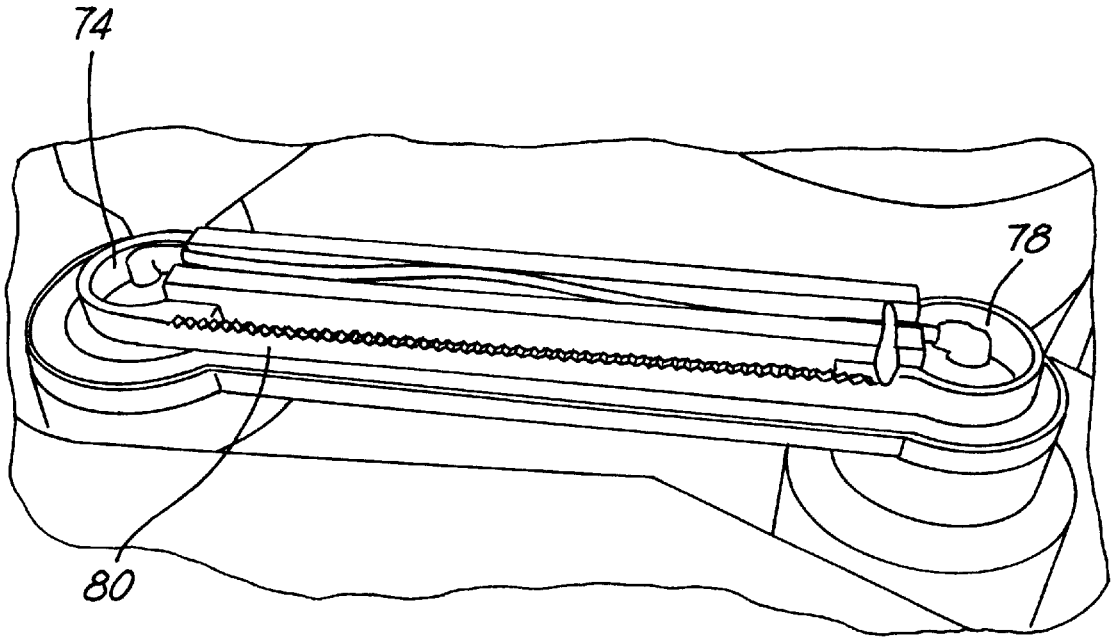
FIG. 6 is a perspective view showing the components of two pulleys and a drive belt used in the present invention pad assembly.

Referring now to FIG. 3, wherein a present invention cover for a pad assembly conditioning assembly is shown. The cover 90 is formed by two substantially circular sections 92, 94 for accommodating two pulleys 74, 78 (shown in FIG. 6), and a substantially elongated, linear straight section 96 that connects the two circular sections 92, 94 for accommodating a drive belt 80 (shown in FIG. 6) when the cover 90 is mounted on to a pad conditioning assembly. As shown in FIG. 3, the body portion of the cover 90 has a substantially flat top surface 98, a curvilinear sidewall 100 and an open bottom 102. At least two boss sections 104, i.e. four boss sections are shown in FIG. 3, situated opposite each other are integrally formed in the curvilinear sidewall 100 each provided with a mounting hole 106 (shown in FIG. 4) that opens to the bottom surface 108 of the curvilinear sidewall 100.

Figure 1A:
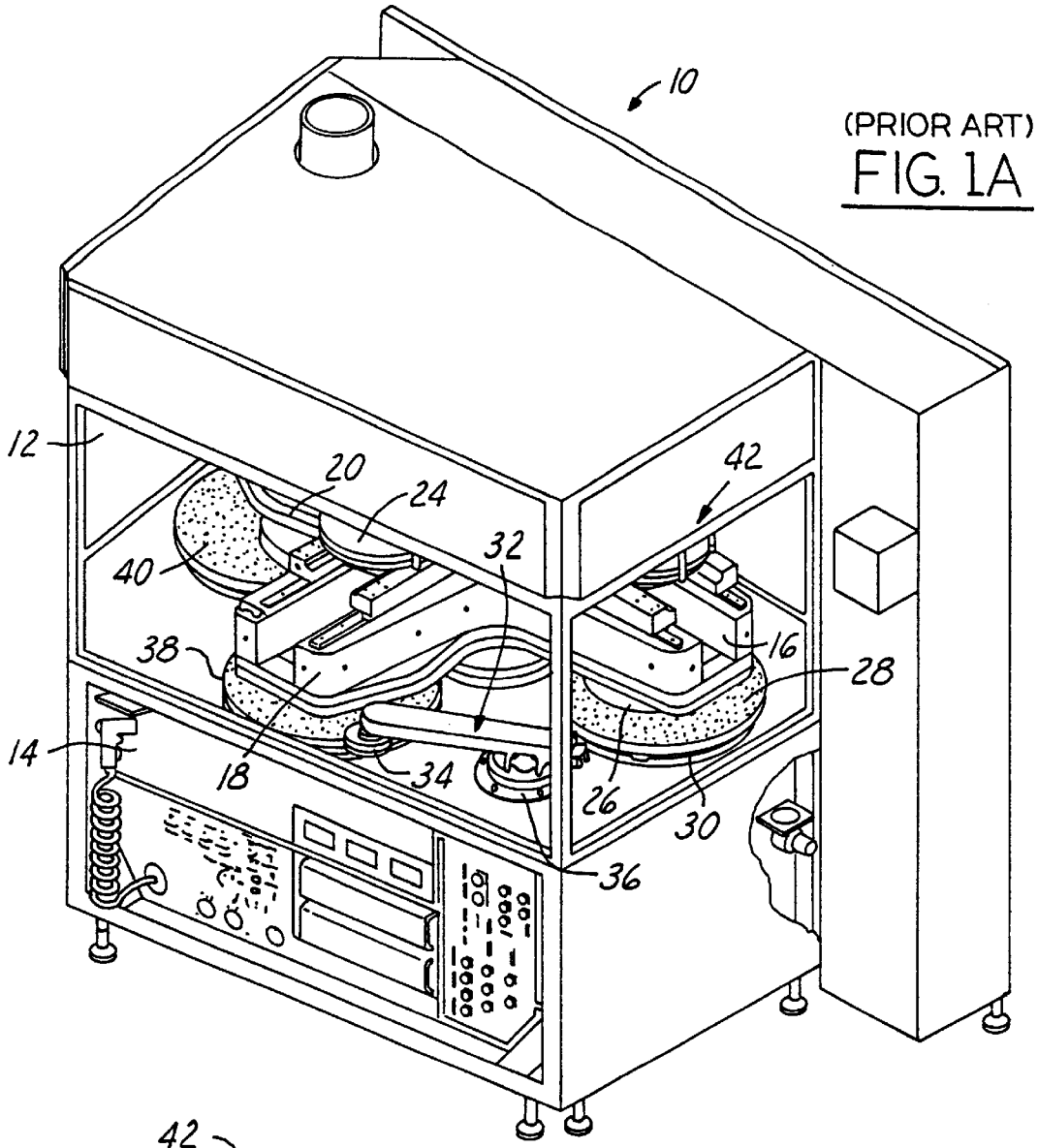
(PRIOR ART) FIG. 1A
FIG. 1A is a perspective view of a conventional chemical mechanical polishing apparatus enclosed in a control cabinet.
Figure 1B:
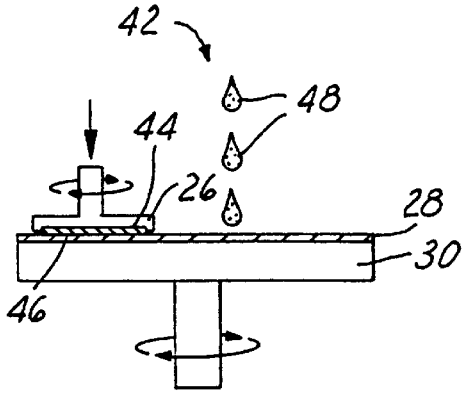
(PRIOR ART) FIG. 1B
FIG. 1B is a cross-sectional view illustrating the relationship of a wafer carrier and a polishing platen.
Figure 1C:
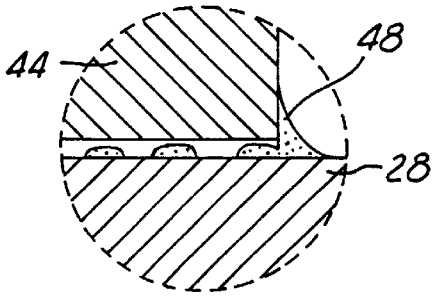
(PRIOR ART) FIG. 1C
FIG. 1C is an enlarged, cross-sectional view illustrating slurry interaction between a wafer surface and a polishing pad surface.
Figure 2A:
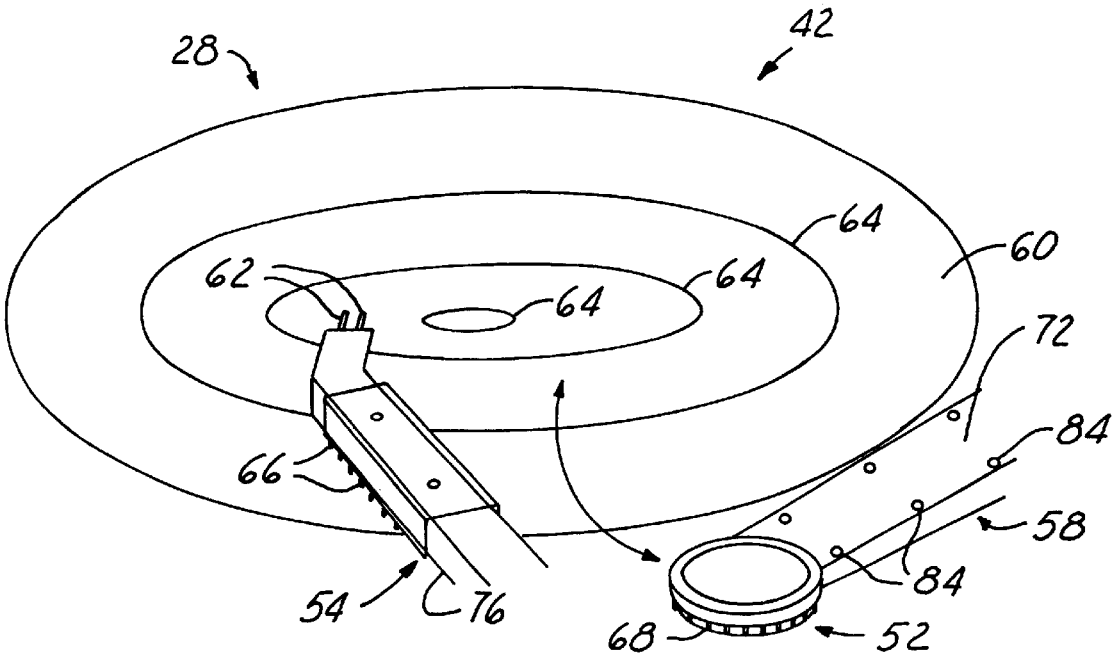
(PRIOR ART) FIG. 2A
FIG. 2A is a perspective view of a polishing station equipped with a slurry dispensing head and a pad conditioning arm.
Figure 2B:
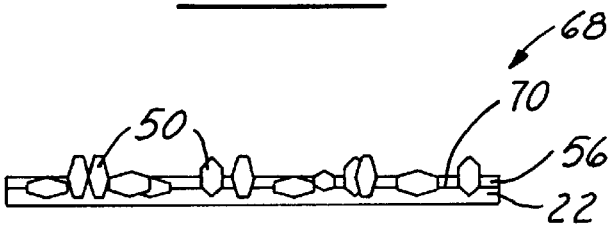
(PRIOR ART) FIG. 2B
FIG. 2B is a cross-sectional view of a pad conditioning disk.
Figure 5:
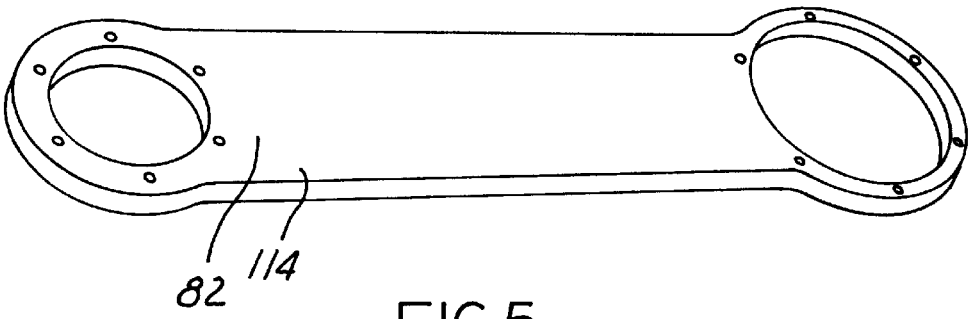
FIG. 5 is a perspective view of a support plate used in the present invention pad conditioning arm.
Figure 7:
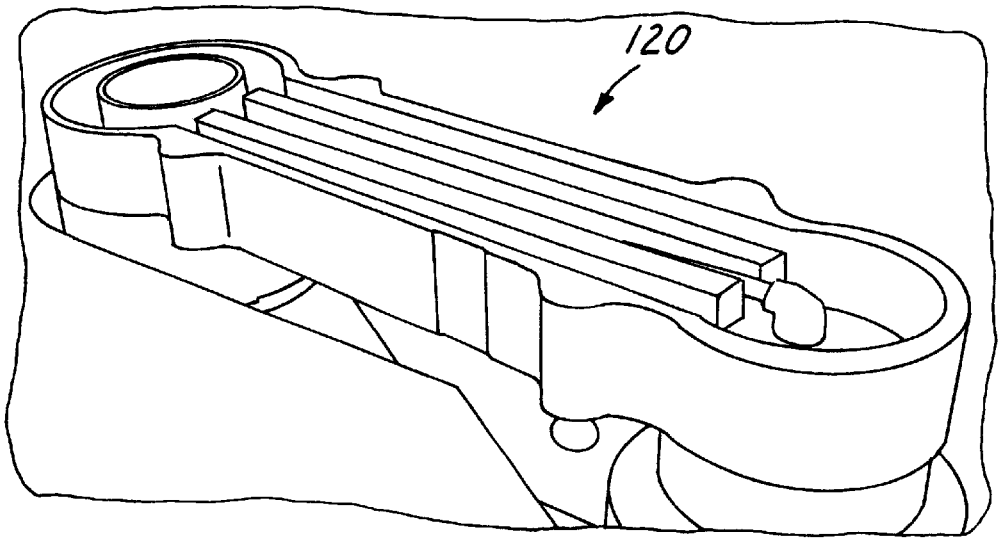
FIG. 7 is a perspective view illustrating the present invention transparent cover installed on a pad conditioning assembly.

Also shown in FIG. 3 are four locking tabs 110 each mounted in a mounting hole 106 located in one of the four boss sections 104 by a mounting pin 112. Each of the locking tabs 110 is rotatable about the mounting pin 112 so as to rotate from a release position to a lock position (shown in FIGS. 3 and 4A) upon engaging an edge portion 114 (shown in FIG. 5) of a support plate 82 in the pad conditioning assembly 120 (shown in FIG. 7).

The body of the cover 90 is preferably formed of a polymeric material that is substantially, optically transparent. For instance, formed by a material of an acrylic plastic. The curvilinear sidewall 100 of the body preferably has a depth with an extended skirt section 118 to shield substantially all the components in the pad conditioning assembly from a polishing slurry and various cleaning fluids.

Each of the locking tabs 110 may be further provided with a frictional surface on a tip portion 116 opposite to the mounting pin 112 for frictionally engaging the edge portion 114 of the support plate 82. The frictional surface may be suitably formed of an elastomeric material. The mounting pins 112 may further be provided with threads for mounting into a threaded hole. The locking tabs 110 may be advantageously fabricated of a rigid metal material, such as aluminum.

The present invention novel cover for a pad conditioning assembly for use in a CMP apparatus and a pad conditioning assembly incorporating such cover have therefore been amply described in the above descriptions and in the appended drawings of FIGS. 3~7.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A cover for a pad conditioning assembly used in a chemical mechanical polishing apparatus comprising:

a body formed of two circular sections adapted to accommodate two pulleys connected by an elongated, substantially linear section therein-between, said body having a substantially flat top surface, a curvilinear sidewall and an open bottom;

at least two boss sections situated opposite to each other integrally formed in said curvilinear sidewall each having a mounting hole that opens to a bottom surface of said curvilinear sidewall; and at least two locking tabs each mounted in a mounting hole in one of said at least two boss sections by a mounting pin, each of said at least two locking tabs being rotatable about said mounting pin so as to rotate from a release position to a lock position upon engaging an edge portion of a support plate of said pad conditioning assembly.

2. A cover for a pad conditioning assembly used in a chemical mechanical polishing apparatus according to claim 1, wherein said body being formed of a polymeric material that is substantially, optically transparent.

3. A cover for a pad conditioning assembly used in a chemical mechanical polishing apparatus according to claim 1, wherein said curvilinear sidewall of said body having a depth that is sufficiently large to shield substantially all components in said pad conditioning assembly from polishing slurry and cleaning liquids.

4. A cover for a pad conditioning assembly used in a chemical mechanical polishing apparatus according to claim 1, wherein each of said at least two locking tabs further comprises a frictional surface on a tip portion opposite to said mounting pin for frictionally engaging said edge portion of the support plate.

5. A cover for a pad conditioning assembly used in a chemical mechanical polishing apparatus according to claim 1, wherein said mounting pin being provided with screw threads.

6. A cover for a pad conditioning assembly used in a chemical mechanical polishing apparatus according to claim 1, wherein said at least two locking tabs are fabricated of a metallic material.

7. A cover for a pad conditioning assembly used in a chemical mechanical polishing apparatus according to claim 1, wherein said body being formed of an acrylic plastic.

8. A pad conditioning assembly used in a chemical mechanical polishing apparatus comprising:

a support plate of elongated shape formed of a rigid material;

a first and a second pulley each rotatably mounted at an opposite end of said support plate;

a drive belt mounted over said first and second pulley for transmitting a rotational motion from said first pulley to said second pulley; and a cover for mounting over said support plate, said first and second pulley and said drive belt comprising a body formed of two circular sections adapted to accommodate two pulleys connected by an elongated, substantially linear section therein-between, said body having a substantially flat top surface, a curvilinear sidewall and an open bottom, at least two boss sections situated opposite to each other integrally formed in said curvilinear sidewall each having a mounting hole that opens to a bottom surface of said curvilinear sidewall, and at least two locking tabs each mounted in a mounting hole in one of said at least two boss sections through a mounting pin, each of said at least two locking tabs being rotatable about said mounting pin so as to rotate from a release position to a lock position upon engaging an edge portion of a support plate of said pad conditioning assembly.

9. A pad conditioning assembly used in a chemical mechanical polishing apparatus according to claim 8, wherein said body of the cover being fabricated of a substantially transparent plastic.

10. A pad conditioning assembly used in a chemical mechanical polishing apparatus according to claim 8, wherein said body of the cover being fabricated of an acrylic plastic.

11. A pad conditioning assembly used in a chemical mechanical polishing apparatus according to claim 8 further comprising a conditioning disk mounted to one of said first and second pulley for conditioning a polishing pad.

12. A pad conditioning assembly used in a chemical mechanical polishing apparatus according to claim 8 further comprising a motor operatively connected to one of said first and second pulley for rotating said pulley.

13. A pad conditioning assembly used in a chemical mechanical polishing apparatus according to claim 8, wherein each of said at least two locking tabs further comprises a frictional surface on a tip portion opposite to said mounting pin for frictionally engaging said edge portion of the support plate.

14. A pad conditioning assembly used in a chemical mechanical polishing apparatus according to claim 13, wherein said frictional surface being formed of an elastomeric material.

15. A pad conditioning assembly used in a chemical mechanical polishing apparatus according to claim 8, wherein said mounting pin being provided with screw threads.

16. A pad conditioning assembly used in a chemical mechanical polishing apparatus according to claim 8, wherein said at least two locking tabs are fabricated of a metallic material.

17. A pad conditioning assembly used in a chemical mechanical polishing apparatus according to claim 8, wherein said support plate being formed of aluminum.

18. A pad conditioning assembly used in a chemical mechanical polishing apparatus according to claim 8, wherein said first and second pulley being mounted on ball bearings.

19. A pad conditioning assembly used in a chemical mechanical polishing apparatus according to claim 8, wherein said curvilinear sidewall of said body having a length that is sufficiently large to shield substantially all components in said pad conditioning assembly from a polishing slurry and cleaning liquids.

20. A pad conditioning assembly used in a chemical mechanical polishing apparatus according to claim 8, wherein said at least two locking tabs being four locking tabs with two mounted on each side of said curvilinear sidewall.

* * * * *